US006663235B2

(12) United States Patent
Erickson et al.

(10) Patent No.: US 6,663,235 B2
(45) Date of Patent: Dec. 16, 2003

(54) COVERLAYER BASED ON FUNCTIONAL POLYMERS

(75) Inventors: David L. Erickson, Philomath, OR (US); Gary J. Watts, Albany, OR (US); Ravi Prasad, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 87 days.

(21) Appl. No.: 10/004,336

(22) Filed: Oct. 31, 2001

(65) Prior Publication Data

US 2003/0081090 A1 May 1, 2003

(51) Int. Cl.[7] ..... B41J 2/35
(52) U.S. Cl. ..... 347/87; 347/50
(58) Field of Search ..... 347/50, 86, 87, 347/58; 428/424.2, 458; 427/516–517

(56) References Cited

U.S. PATENT DOCUMENTS 4,502,060 A 2/1985 Rankin et al.
4,883,717 A * 11/1989 Kitamura et al. ..... 428/458
5,159,006 A 10/1992 Breant
5,364,669 A * 11/1994 Sumida et al. ..... 428/1
5,405,565 A * 4/1995 Sumida et al. ..... 264/171
5,442,384 A 8/1995 Schantz et al.
5,442,386 A 8/1995 Childers et al.
5,491,505 A 2/1996 Suzuki et al.
5,648,805 A 7/1997 Keefe et al.
5,696,546 A 12/1997 Narang et al.
5,736,998 A 4/1998 Caren et al.
5,849,824 A 12/1998 Mercer et al.
5,852,460 A 12/1998 Schaeffer et al.
5,863,662 A 1/1999 Hornby et al.
6,062,679 A 5/2000 Meyer et al.
6,139,137 A 10/2000 Stathem et al.
6,218,017 B1 * 4/2001 Yamashita et al. ..... 428/424.2
6,244,696 B1 6/2001 Tran et al.
6,482,530 B2 * 11/2002 Ito et al. ..... 428/475.5
6,506,460 B1 * 1/2003 Paglia et al. ..... 427/517

* cited by examiner

*Primary Examiner*—Anh T. N. Vo

(57) ABSTRACT

In one embodiment of the invention, a structure for preventing ink shorting of conductors connected to a printhead is provided. The structure includes a layer of insulating material shaped to at least partially encapsulate the conductors on the printhead. The insulating material includes a first surface and a second surface, with each of the surfaces having an adhesive coated thereon. The adhesive includes a polymer of ethylene and glycidyl methacrylate. The adhesive may also further include an acrylic ester. Alternatively, a first adhesive may be coated onto a first surface of the insulating material or coverlayer and a second adhesive (distinct in composition from the first adhesive) may be coated onto a second surface of the insulating material or coverlayer. In another embodiment of the invention, a print cartridge for an inkjet printer, including the structure for preventing ink shorting of conductors connected to the printhead is provided.

20 Claims, 8 Drawing Sheets

COVERLAYER BASED ON FUNCTIONAL POLYMERS

FIELD OF THE INVENTION

The present invention generally relates to inkjet printing and, more specifically, to methods and structures for securing a printhead to an inkjet print cartridge, whereby ink is prevented from shorting printhead conductors together.

BACKGROUND OF THE INVENTION

Substantial developments have been made in the field of electronic printing technology. Specifically, a wide variety of highly efficient printing systems currently exist which are capable of dispensing ink in a rapid and accurate manner. One such system is a thermal inkjet printer that utilizes ink cartridges. Thermal inkjet print cartridges operate by rapidly heating a small volume of ink to cause the ink to vaporize and be ejected through one of a plurality of orifices so as to print a dot of ink on a recording medium such as a sheet of paper. Typically, the orifices are arranged in one or more linear arrays in a nozzle plate. The properly sequenced ejection of ink from each orifice causes characters or other images to be printed upon the paper as the printhead is moved across the paper. The paper is typically shifted each time the printhead has moved across the paper. The thermal inkjet printer is fast and quiet, as only the ink strikes the paper. These printers produce high quality printing and can be made both compact and affordable.

A typical inkjet print cartridge is shown in FIG. 1 as print cartridge 20, which includes an ink reservoir 22 for containing liquid ink. The liquid ink is delivered to a printhead 24 that is formed of a flexible polymer tape 30 using Tape Automated Bonding (TAB). Printhead 24 includes a nozzle member 28 comprising offset holes or orifices 26 formed in the flexible polymer tape 30.

Referring to FIG. 2, a back surface of tape 30 includes conductors 42 formed thereon by, for example, using a conventional photolithographic etching and/or plating process. These conductors are terminated by large contact pads 32 (FIG. 1) designed to interconnect with a printer. Print cartridge 20 is designed to be installed in a printer so that contact pads 32, on the front surface of tape 30, contact printer electrodes providing externally generated energy signals to the printhead. Windows 34 and 36 (FIG. 1) extend through tape 30 and are used to facilitate bonding of the ends of the conductors to electrodes on a silicon substrate containing heater resistors.

In the standard print cartridge assembly, the conductors are formed on the back surface of tape 30 (opposite the surface which faces the recording medium). To access these conductors from the front surface of tape 30, holes (vias) must be formed through the front surface of tape 30 to expose the ends of the conductors. The exposed ends of the conductors are then plated with, for example, gold to form contact pads 32 shown on the front surface of tape 30. When print cartridge 20 is properly positioned in an inkjet printer, contact pads 32 are pressed against associated contacts on the inkjet printer so as to electrically couple the resistors to a source of electrical current.

Affixed to the back of tape 30 is a silicon substrate 38 containing a plurality of individually energizable thin film resistors. Each resistor is located generally behind a single orifice 26 (FIG. 1) and acts as an ohmic heater when selectively energized by one or more pulses applied sequentially or simultaneously to one or more of contact pads 32 (FIG. 1). Conductors 42 lead from the contact pads 32 to electrodes on substrate 38. Hole 40 allows ink from an ink reservoir to flow to the front surface of substrate 38.

The print cartridge structure has a number of drawbacks. For example, conductors that extend out from a flexible circuit and connect to electrodes on a substrate require adequate insulation on the bottom surface of the conductors formed on the bottom surface of the flexible circuit. During the course of printing, cleaning operations need to be done to prevent nozzles from clogging. In addition, spray from the ink ejection is generated. As a result, the ink manages to reach the underside of the flexible circuit, which causes some degree of shorting between conductors. Even at low voltage levels and at fairly low operating speeds, this shorting together of conductors can affect the operation of the printhead. Where higher performance printers and printheads are utilized, which require faster and faster speeds and possibly incorporate active demultiplexing circuitry on the printhead itself, the problem is compounded. Thus, high current power supply voltages and low current control signals that are or will be carried by conductors connected to currently available or future printheads, may result in ink shorting between these conductors which can significantly affect the characteristics of the control signals and may, therefore, cause significant fluctuations in print quality.

Previous solutions to the ink shorts problem have primarily focused on (1) modifying the design on top of the substrate, the layout and geometry of the thin film, thick film and the TAB bond window opening and (2) improving the chemical and mechanical robustness of the adhesive materials and interfaces.

U.S. Pat. No. 5,442,384, entitled "Integrated Nozzle Member and TAB Circuit for Inkjet Printhead," describes a novel nozzle member for an inkjet print cartridge having a barrier layer, as a separate layer or formed in the nozzle member itself, and including vaporization chambers surrounding each orifice and ink flow channels which provide fluid communication between an ink reservoir and the vaporization chambers. U.S. Pat. No. 5,648,805, entitled "Adhesive Seal for an Inkjet Printhead," describes a procedure for sealing an integrated nozzle and flexible or tape circuit to a print cartridge, whereby a flexible circuit is adhesively sealed with respect to the print cartridge body by forming an ink seal, circumscribing the substrate, between the back surface of the flexible circuit and the body, thus providing a seal directly between a flexible circuit and an ink reservoir body. U.S. Pat. No. 5,736,998, entitled "Inkjet Cartridge Design for Facilitating the Adhesive Sealing of a Printhead to an Ink Reservoir," and U.S. Pat. No. 5,852,460, entitled "Inkjet Print Cartridge Design to Decrease Deformation of the Printhead When Adhesively Sealing The Printhead to the Print Cartridge," describe improved headland designs. However, these designs did not address the problem of ink shorts caused by ink leaking into the conductive leads and conductive traces of the flexible circuit.

On most flexible circuits, these leads are also protected on the back side by a laminated cover layer. For example, U.S. Pat. No. 5,442,386 describes a typical print cartridge assembly including a coating that is laminated to the back side of a tape on which the conductors are formed. The coating comprises a middle layer of polyethylene terephthalate (PET) and two additional outer layers composed of a copolyester film. The three layers are laminated together and provided on a roll. While this coverlayer resolves some of the shortcomings of the prior art methods and print cartridge assemblies, it requires use of a fully-cured and/or multiple-layered coverlayer which increases the cost of production dramatically and complicates the manufacturing process.

Other known print cartridge assemblies have simply relied on use of a single coating, usually consisting of a PET core, coated with a first layer of adhesive on one side and a second layer of adhesive on the other side of the PET core. However, there are a number of disadvantages to this current approach. Current coverlayer adhesives used in the industry are either soluble in ink and polyethylene glycol (PEG) (the latter being used in the printer service station), or will not adhere to adjacent materials used in the cartridge. In view of the solubility of these adhesives to common components in printers, the coverlayers containing such adhesives provide minimal protection to the flexible circuits located on the backside of the print cartridge.

While considerable gains have been made in both of these areas, they are limited in their effectiveness and an additional robustness margin is desired. Accordingly, there is a need for an improved method of encapsulating the flexible circuit leads that reduces ink shorts and corrosion due to ink penetration into the flexible circuit leads. More specifically, there is a need for a coverlayer material that is robust and stable in the presence of ink and PEG, which is able to maintain adhesion to the pen body, and which further prevents electrical shorts between traces on the circuit due to water vapor or ink.

SUMMARY OF THE INVENTION

The present invention includes an improved structure for an inkjet print cartridge and a method for securing a printhead to the cartridge, whereby ink is prevented from shorting the printhead conductors together.

In one embodiment of the invention, conductors formed on a surface of a flexible circuit are encapsulated by a layer of insulation to prevent ink seeping under the flexible circuit from shorting the conductors together. More specifically, a structure for preventing ink shorting of conductors connected to a printhead is provided. The structure includes a layer of insulating material shaped to at least partially encapsulate the conductors on the printhead. The insulating material includes a first surface and a second surface, with each of the surfaces having an adhesive coated thereon. The adhesive includes a polymer of ethylene and glycidyl methacrylate. In yet another embodiment of the invention, the adhesive further includes an acrylic ester. Alternatively, a first adhesive may be coated onto a first surface of the insulating material or coverlayer and a second adhesive (distinct in composition from the first adhesive) may be coated onto a second surface of the insulating material or coverlayer.

In another embodiment of the invention, a print cartridge for an inkjet printer is provided. The print cartridge includes a polymer tape having a nozzle member formed therein and additionally having a first surface containing conductors thereon. The nozzle member includes a plurality of ink orifices. The print cartridge further includes a coverlayer having a first surface and a second surface. Each coverlayer surface has an adhesive coated thereon. The coverlayer first surface is bonded to the first surface of the polymer tape by the adhesive so as to substantially encapsulate the conductors and prevent electrical shorts caused by water vapor or ink. The adhesive includes a polymer of ethylene and glycidyl ethacrylate. Alternatively, the adhesive further includes an acrylic ester. The coverlayer is bonded to a print cartridge body containing an ink-retaining compartment therein, such that the nozzle member is in fluid communication with the ink-retaining compartment.

In yet another embodiment of the invention, a method of producing a print cartridge for use in an inkjet cartridge is provided. The method includes providing a polymer tape having a nozzle member formed therein and having a first surface containing conductors thereon. The nozzle member includes a plurality of ink orifices. A coverlayer having a first surface and a second surface is provided. Each coverlayer surface includes an adhesive coated thereon. The first surface of the coverlayer is bonded to the first surface of the polymer tape in order to substantially encapsulate the conductors and prevent electrical shorts caused by water vapor or ink. The adhesive includes a polymer of ethylene and glycidyl methacrylate. Alternatively, the adhesive further includes an acrylic ester. A print cartridge body containing an ink-retaining compartment therein is then provided. The second surface of the coverlayer is then bonded to the print cartridge body such that the nozzle member is in fluid communication with the ink-retaining compartment.

The particular structure of the printhead is not important in this patent application and various types of printheads, such as those with a nickel nozzle plate, may also be used with the present invention.

DESCRIPTION OF THE DRAWINGS

While the specification concludes with claims particularly pointing out and distinctly claiming that which is regarded as the present invention, the present invention can be more readily ascertained from the following description of the invention when read in conjunction with the accompanying drawings in which:

DETAILED DESCRIPTION OF THE INVENTION

The present invention prevents liquid ink from shorting together conductors connected to a printhead. One particular aspect of the present invention includes a coverlayer material that is robust and stable in the presence of ink, water vapor and PEG, is able to maintain adhesion to the pen body, and prevents electrical shorts between traces on the circuit due to water vapor or ink. The particular structure of the printhead is not important in this patent application, and various types and designs of printheads may also be used with the present invention. Therefore, the present invention will be described with reference to known structures for print cartridges and flexible polymer tapes, as previously described in FIGS. 1 and 2.

Figure 1:
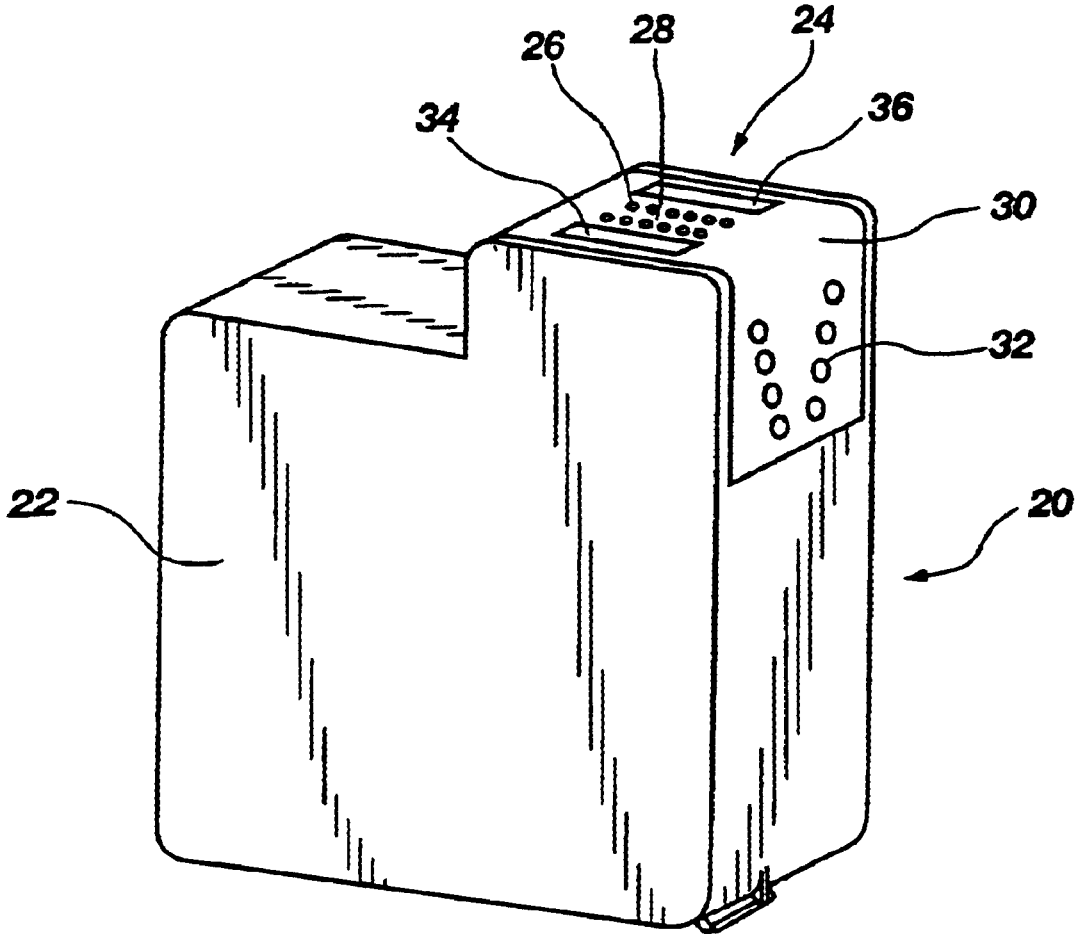
Fig. 1 (PRIOR ART)
FIG. 1 is a perspective view of an inkjet print cartridge according to one embodiment of the present invention.

Referring to FIG. 1, an inkjet print cartridge 20 is shown that includes an ink reservoir 22, and a printhead 24. Printhead 24 includes a nozzle member 28 comprising two parallel columns of offset holes or orifices 26 formed in a flexible polymer tape 30 by, for example, laser ablation. Polymer tape 30 may be purchased commercially as KAPTON™ tape (available from 3M Corporation). It is understood that in other embodiments, flexible polymer tape 30 can be any material suitable for use in a print cartridge assembly known to those persons of skill in the art.

Figure 2:
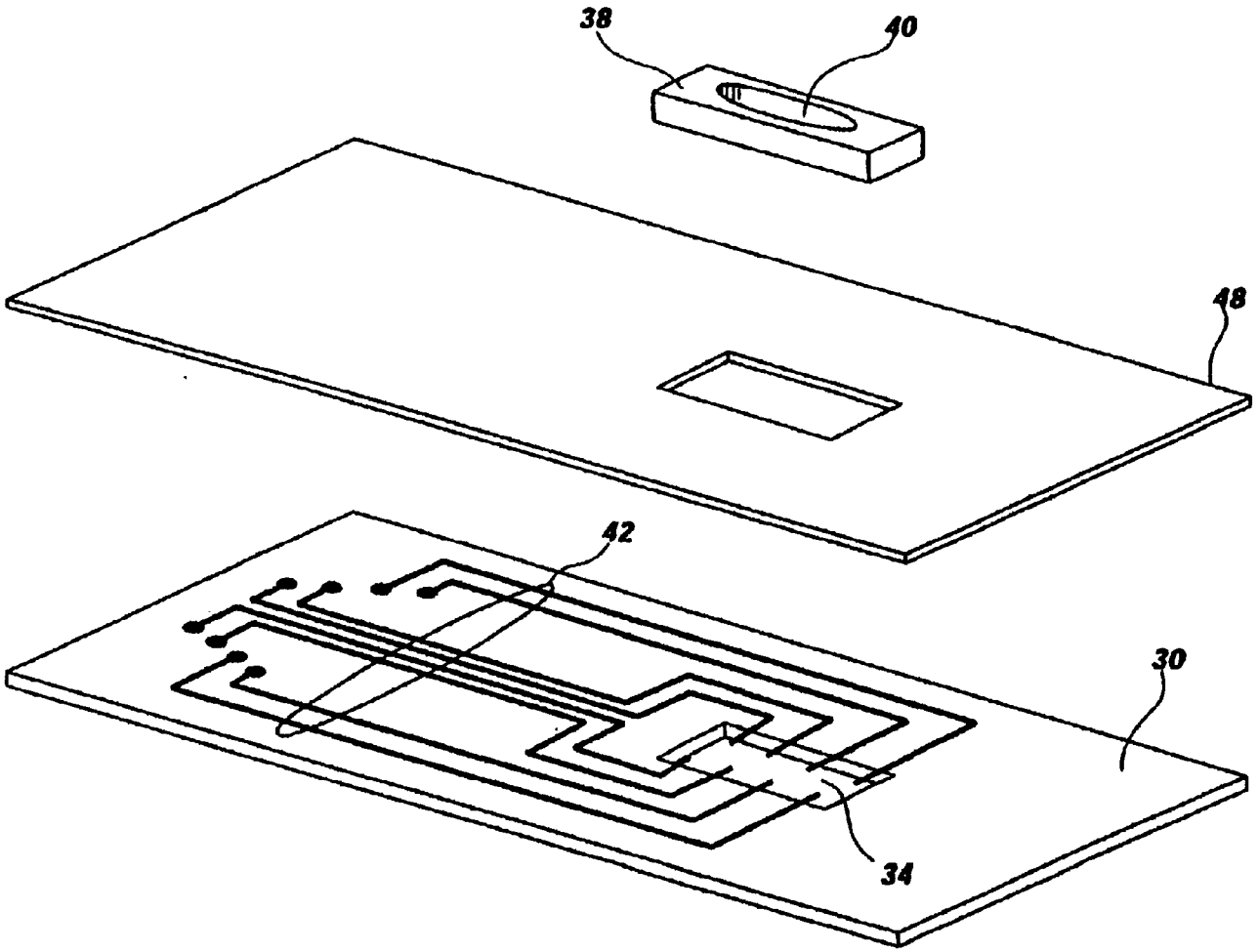
Fig. 2 (PRIOR ART)
FIG. 2 is an exploded perspective view of the back surface of the printhead assembly (tape) of FIG. 1 with conductive leads attached to the substrate.

In a particular embodiment of the invention, the back surface of tape 30 on which the conductors 42 (FIG. 2) are formed has a first adhesive layer formed on it, followed by a layer of polyethylene terephthalates (PET), followed by a second layer of adhesive. The adhesive/PET coating encapsulates and insulates the conductors to protect the encapsulated portion of the conductors on tape 30 from coming into contact with ink or water vapor and, thus, preventing electrical shorts. A coating or coverlayer 48, shown in FIG. 2, is laminated to the back side of tape 30 on which the conductors 42 are formed. In one particular embodiment, the coating 48 has three layers that consist of a polyethylene terephthalate (PET) core (or any other suitable material) coated with a first layer of adhesive on one side and a second layer of adhesive on the other side. It is understood that the first and second layers of adhesive may consist of the same adhesive or of different adhesives. Prior to attaching the coating 48 to tape 30, the coating 48 may be punched to a shape matching the area of tape 30 to be coated. The PET layer, having better structural integrity than the adhesive, makes this punching operation more feasible. When the coating 48 is laminated to the back side of tape 30 (over the conductors), heat and/or pressure may be used to temporarily soften the first adhesive to enhance adhesion to tape 72 and assure that conductors 42 are encapsulated. The PET layer has a second function of assuring that coating 48 has no holes that would allow ink to flow through and reach conductors 72. In summary, the present structure allows for easy material handling, adhesion to tape 30, adhesion to the print cartridge 20 material, and fluidic sealing of conductors 42 from water vapor, PEG, and ink. The resulting tape 30 with the printhead is then positioned on the print cartridge "snout" and heated so that the second layer of adhesive covering the conductors now secures tape 30 to print cartridge 20.

In an alternative embodiment of the present invention, a coating 48 may consist of a PET core coated with a single layer of adhesive on one side of the PET layer that is to be laminated to the back side of tape 30. It is understood that various methods of applying a coverlayer to tape 30 can be envisioned so long as the coating 48 layer provides the required protection to the conductors of tape 30. For example, in an alternative embodiment of the invention, the back side of tape 30 is coated with the adhesive, followed by application of coating 48 thereon (and over the conductors lying on back side of tape 30).

In yet another embodiment, the second adhesive has a lower melting point than the first adhesive to ensure that tape 30 does not separate from the first adhesive while affixing the second adhesive to the snout of the print cartridge 20.

In one particular embodiment, a three-layer coating is provided and laminated over the tape and conductors. The starting material is a flexible tape having conductors formed thereon, as previously described. The three-layer coating is then aligned with respect to the tape and tacked in place thereon. In this particular embodiment, coating 48 can comprise a middle layer of PET approximately 0.4 mils thick and two outer layers composed of, for example, a copolyester film approximately 1.0 mil thick. Suitable copolyester films can be formed of ethyl vinyl acetate (EVA) and/or ethyl acrylic acid (EAA). The materials comprising the two outer layers are typically designed to withstand temperatures of 200° C. and above. The three layers can be laminated together and provided on a roll.

The invention is further explained by the use of the following illustrative examples:

EXAMPLES

Example I

Polymer Adhesives

Laminates of Lotader® 8900 and Lotader® 8840 with plasma treated Kapton™ E tape were prepared at various time, temperature, and post-baking conditions. The resulting samples were tested in T-peel to assess Lotader® to Kapton™ adhesion. Lotader® 8900 is a terpolymer of ethylene, methyl acrylate, and glycidyl methacrylate. Lotader® 8840 is a copolymer of ethylene and glycidyl methacrylate. Lotader® 8900 and Lotader® 8840 (available from Elf Atochem, North America, Philadelphia Pa.) possess the following properties and characteristics:

| Properties | Unit | Lotader ® 8900 | Lotader ® 8840 |
|---|---|---|---|
| MFI (190° C., 2.16 kg) (ASTM D 1238) | g/10 mn | 6 | 5 |
| Acrylic Ester content (ATO method) | % | 26 | 0 |
| GMA Content | % | 8 | 8 |
| Melting point (DSC) | ° C. | 60 | 109 |
| Vicat soft. Point (ASTM D 1525) | ° C. | <40 | 87 |
| Young's Modulus (ISO R 527) | MPa | 8 | 104 |
| Tensile strength at break (ASTM D 638) | MPa | 4 | 8.0 |
| Elongation at break (ASTM D 638) | % | 1100 | 400 |

The glycidyl (epoxy) functionality of these adhesives to create chemical bonds to the Kapton™ surface under some of the experimental conditions resulting in markedly higher peel strengths was tested.

Example II

Preparation of Coverlayer

Lotader® 8900 and 8840 were coated onto PET carrier films. Each tape consisted of 1.5 mil adhesive, 1 mil PET, and 1.5 mil adhesive. 48 mm Kapton E was plasma treated using a vertical asher that was evacuated to 60 mtorr and filled with 1.2 torr $O_2$. A radio frequency (RF) of 500 watts and a rate of 2 feet/min were used. After the ashing process, the Kapton was stored in a bell jar dessicator with fresh dessicant throughout the duration of the experiment.

Example III

Lamination Process

A Tetrahedron vacuum laminator was used to perform lamination. Samples were laid up in the following sequence: non-stick cookie sheet, rubber, PET release film, Kapton™, Lotader®, PET release film, non-stick cookie sheet. Four 48 mm wide strips (consisting of PET release film/Kapton™/Lotader®/PET release film layers) were in the center of each layup. PET release film layers spacers were used between the Kapton™ and Lotader® at both ends so that peel testing could be done later. A force of 800 pounds and house vacuum (typically about −23.5 "$H_2O$) was used for all laminations. Samples were rapidly removed from the laminator, were immediately peeled off of the rubber sheet, and the PET release film layers were removed. The samples were then placed on a non-conductive benchtop and allowed to curl to relieve internal stresses. The lamination experimental conditions are summarized in Table 1. Three times and temperatures were used for each coverlayer.

TABLE 1

Lamination Experiment conditions.

| Code | Time (min) | Temp (° C.) | Coverlayer |
|---|---|---|---|
| D | 30 | 160 | 8900 |
| F | 15 | 160 | 8900 |
| A | 0.25 | 160 | 8900 |
| M | 30 | 200 | 8900 |
| I | 15 | 200 | 8900 |
| J | 0.25 | 200 | 8900 |
| P | 30 | 230 | 8900 |
| N | 15 | 230 | 8900 |
| Q | 0.25 | 230 | 8900 |
| E | 30 | 160 | 8840 |
| G | 15 | 160 | 8840 |
| H | 0.25 | 160 | 8840 |
| K | 30 | 200 | 8840 |
| L | 15 | 200 | 8840 |
| B | 0.25 | 200 | 8840 |
| R | 30 | 230 | 8840 |
| O | 15 | 230 | 8840 |
| C | 0.25 | 230 | 8840 |

Example IV

Baking Process

Extra samples (12 each) were prepared using conditions A and C from Table 1. Preliminary samples were laminated and peel tested to determine the initial conditions for each coverlayer. These samples were then baked for 30 minutes at various temperatures under $N_2$ in a Blue M Electric inert gas oven model cc-09 (available from Blue M Electric, St. Watertown, Wis.). The results were compared to samples that were baked under pressure for 30 minutes in the Tetrahedron MTP™ press model 0801 laminator (available from Tetrahedron Associates, Inc., San Diego, Calif.). The resulting experimental conditions regarding bake temperature are shown in Table 2. L was used to denote the low temperature bake (160° C.), M was the middle temperature (200° C.), and H was the high temperature (230° C.).

TABLE 2

Bake DOE conditions.

| Code | Type | Temp | Coverlayer |
|---|---|---|---|
| CL | $N_2$ post bake | 160 | 8840 |
| E | Laminated | 160 | 8840 |
| CM | $N_2$ post bake | 200 | 8840 |
| K | Laminated | 200 | 8840 |
| CH | $N_2$ post bake | 230 | 8840 |
| R | Laminated | 230 | 8840 |
| AL | $N_2$ post bake | 160 | 8900 |
| D | Laminated | 160 | 8900 |
| AM | $N_2$ post bake | 200 | 8900 |
| M | Laminated | 200 | 8900 |
| AH | $N_2$ post bake | 230 | 8900 |
| P | Laminated | 230 | 8900 |

Example V

Peel Test Procedure

Samples were T-peeled using an Instron model 4202 tensile tester (available from Instron Corporation, Canton, Mass.) with a 100N load cell. Two ½ inch wide samples were cut from each 48 mm laminate using the cutting tools. Samples were labeled such that each consecutive pair were from the same laminate (ex. 1 and 2 were from the same laminate). Only the odd samples were peeled for the main experiment, giving 4 data points per condition. The Kapton™ side was placed in a lower clamp and the Lotader® side was placed in an upper clamp. Each sample was peeled for 1 inch (~½ inch on each side) at the rate of 1 inch/minute.

Example VI

Lamination Peel Test Results

A lamination experiment focusing on various time and temperature conditions in the vacuum laminator was performed. The tested time durations were 15 seconds, 15 minutes and 30 minutes. The tested temperatures were 160° C., 200° C., and 230° C.

The data was analyzed separately by coverlayer.

Figure 3:
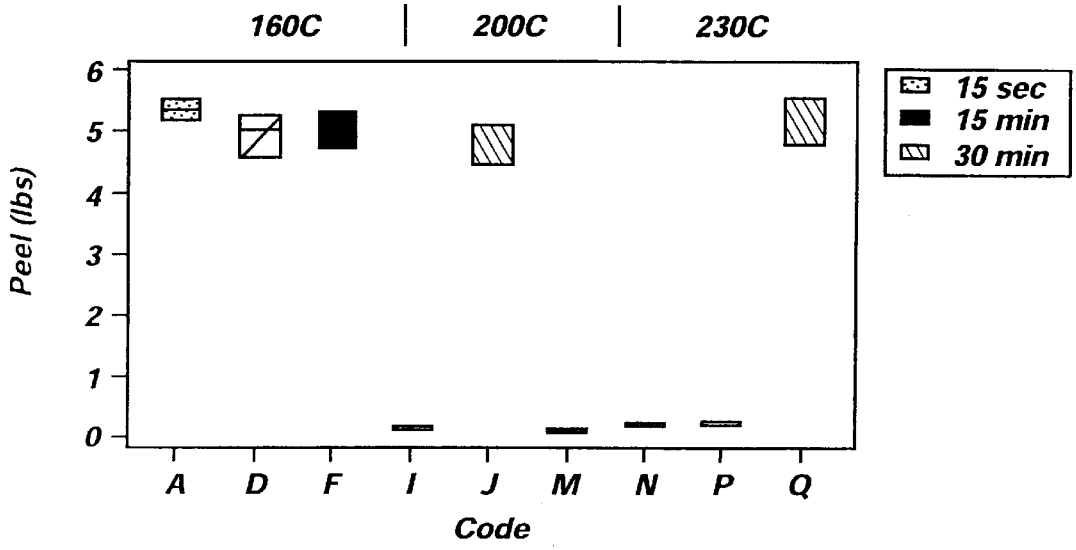
FIGS. 3 through 7 depict the peel strengths and effects of adhesive samples when tested under various time and temperature gradients.

FIG. 3 shows a boxplot of all of the test conditions performed on the coverlayer containing Lotader® 8900. The results demonstrate highest peel strength for all samples baked at 160° C. and for all samples baked for short durations (i.e., 15 seconds).

Figure 4:
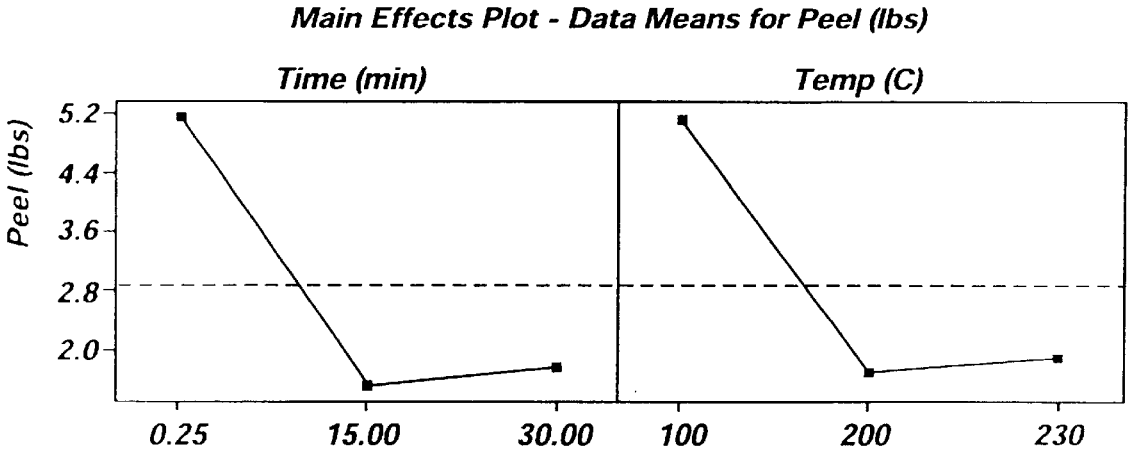

FIG. 4 shows the main effects for time and temperature in these samples. These results suggest that the shortest lamination time (15 seconds) and lowest temperature (160° C.) gave comparatively better results. The p value for both effects is 0 indicating strong significance.

Figure 5:
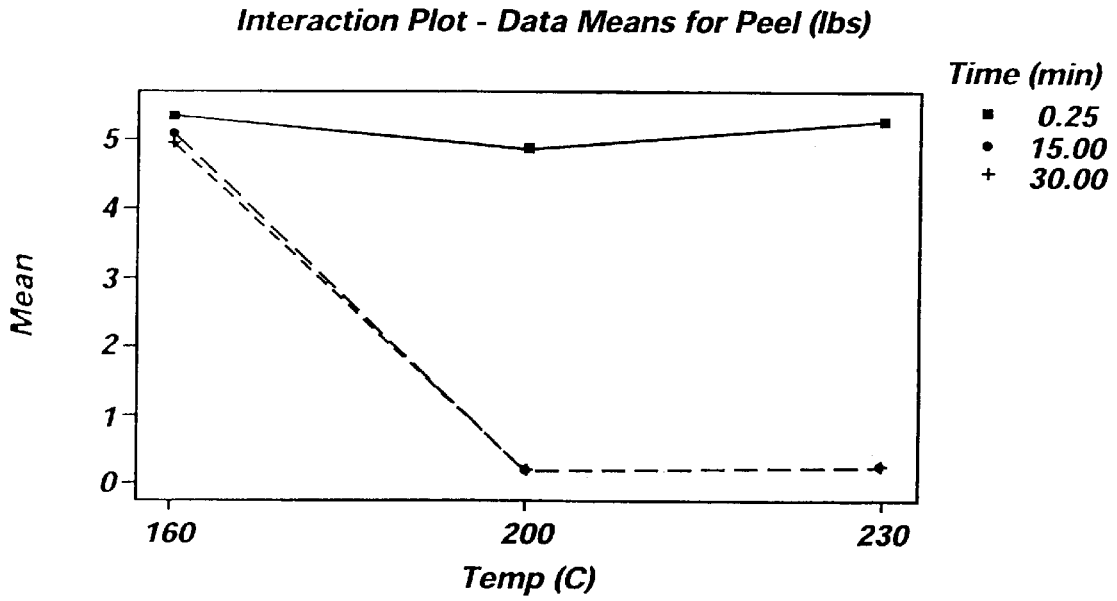

The interaction between time and temperature was also significant with a p value of 0. FIG. 5 shows an interaction plot. All of the samples with short lamination times and all of the samples laminated at 160° C. had higher peel strengths, making the same preferable in uses where high adhesive strength is desirable or required. The samples prepared for longer times at 200 and 240° C. demonstrated relatively diminished peel strengths, making the same more suitable for applications demanding lower adhesive properties.

Figure 6:
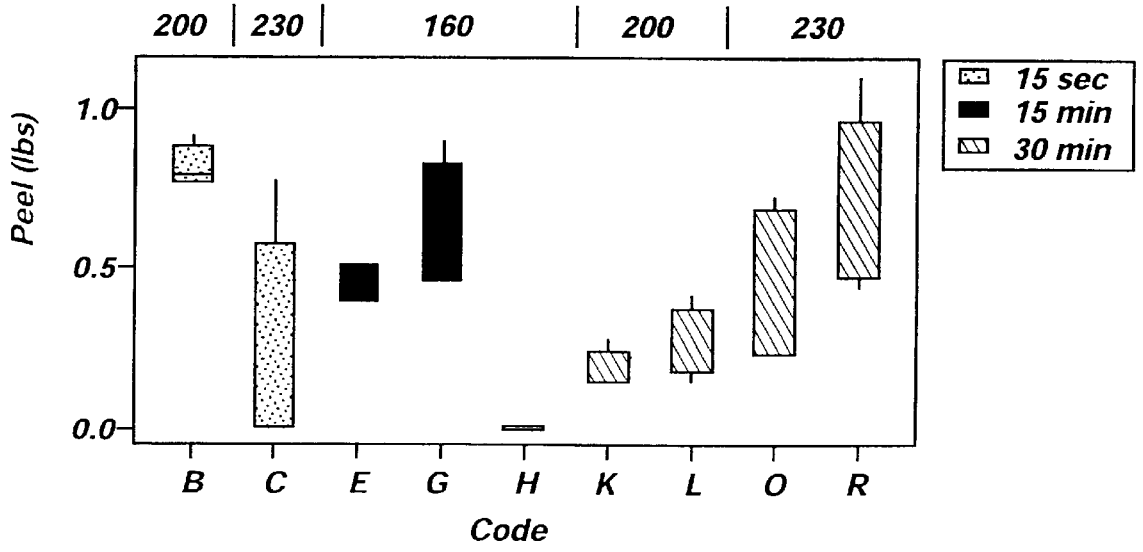
Figure 7:
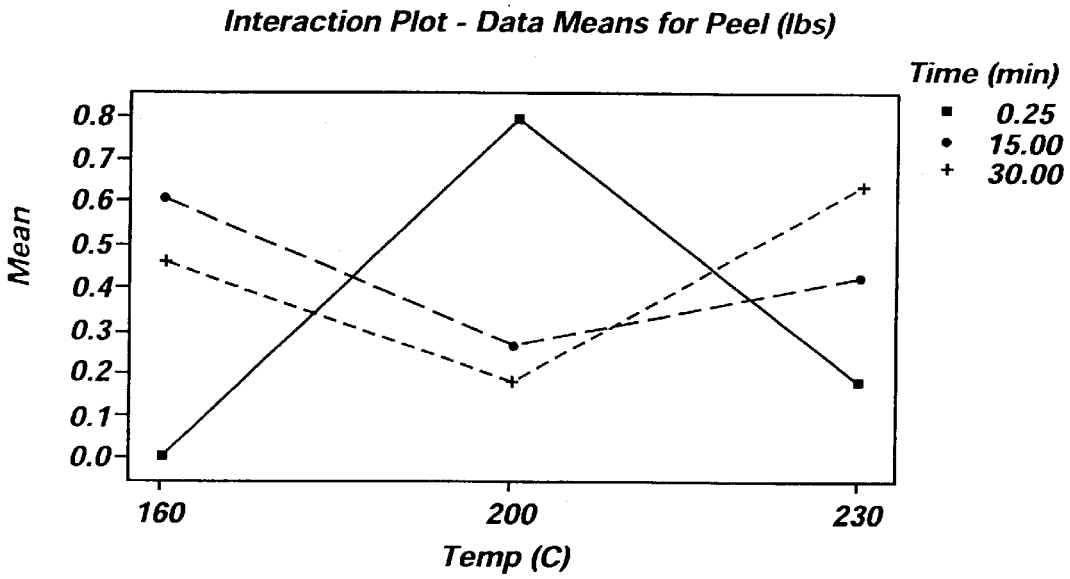

FIG. 6 shows a boxplot of each of the conditions containing Lotader® 8840 adhesive. The interaction for this group was significant with a p value of 0. FIG. 7 shows the interaction plot. As seen therein, Lotader® 8840 samples exhibited more consistent peel strength throughout the spectrum of baking time and temperature lamination conditions, but less overall peel strength when compared to the Lotader® 8900 results described with reference to FIG. 5. The samples baked under 15 second laminations exhibited a peel-strength peak at 200° C. At 160 and 230° C., longer lamination times improved adhesion somewhat, but at 200° C. the longer times were not as good as the samples processed under short lamination times.

Example VII

Post Bake Comparative Test Results

A bake test was conducted to compare samples undergoing 30 minute lamination with samples undergoing a 30 minute post bake after quick (15 second) lamination. Lotader® 8900 samples for post bake were prepared at 160° C. and 8840 samples for post bake were prepared at 230° C. These initial conditions were selected to assure that the samples had significant adhesion before entering the post bake experiments.

Figure 8:
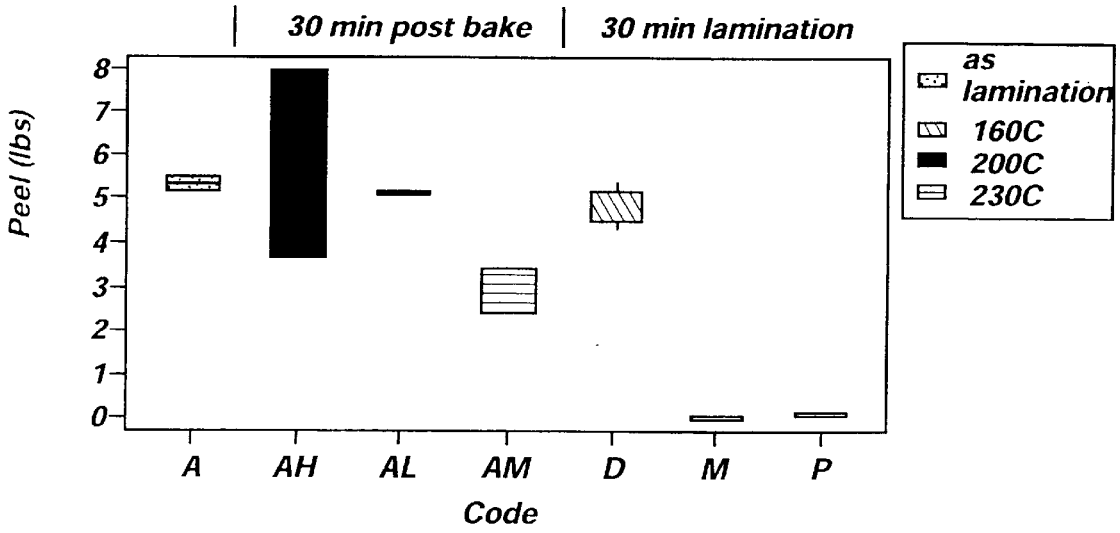
FIGS. 8 through 13 depict the peel strengths and effects of post-baked adhesive samples when tested under various time and temperature gradients.

FIG. 8 shows a boxplot of all of the Lotader® 8900 conditions prepared. The as-laminated parts used for post bake (sample A) are included for comparison. All of the post-baked samples and the 160° C. laminated sample yielded satisfactory results. Samples laminated at 200 and 230° C. had reduced adhesion results. The highest peel strengths were exhibited in samples that were post-baked at 230° C. These samples sustained an extremely high force (approximately 10 pounds).

Figure 9:
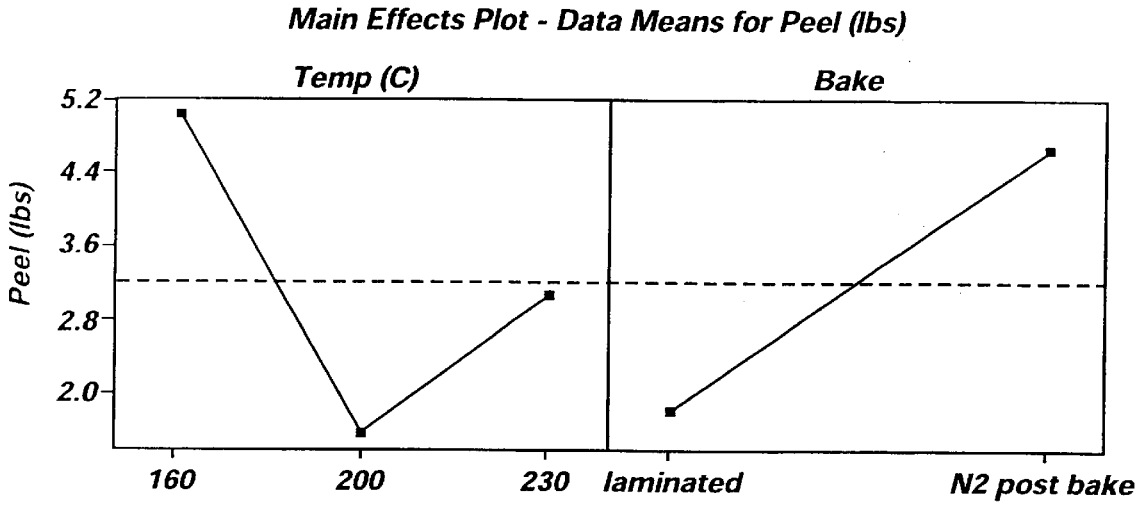

FIG. 9 shows the main effects for bake type and temperature in these samples. The p value for both effects is 0 indicating strong significance. A high temperature post bake was much more effective than holding the samples under pressure. The best peel strengths were seen at 160° C.

Figure 10:
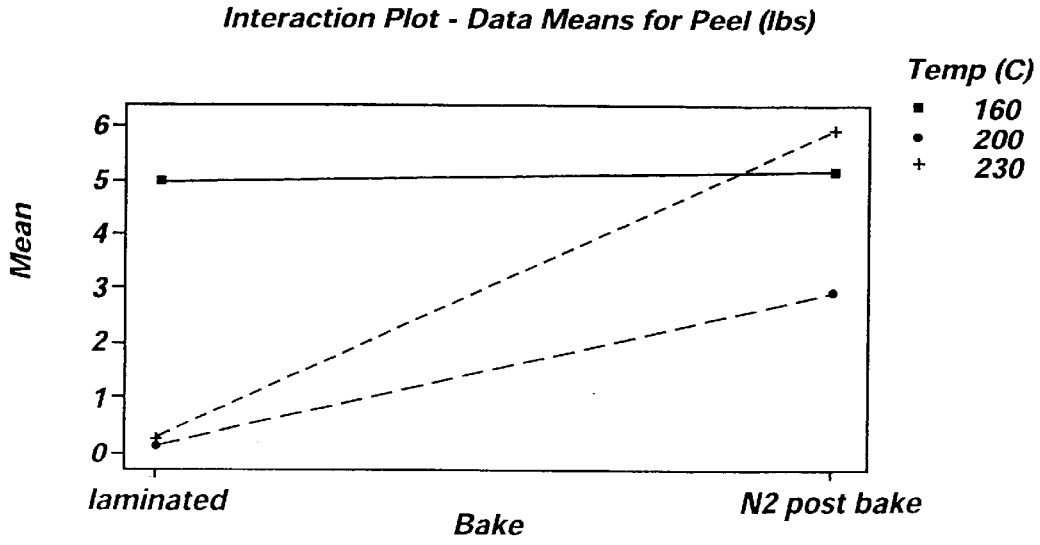

The interaction between bake type and temperature was also significant with a p value of 0, as shown in the interaction plot of FIG. 10. In the laminator, the 160° C. samples all performed well and exhibited the best comparative results. All samples that were post baked showed reasonable adhesion. At 160° C. there wasn't much difference between post baking versus laminating. With respect to 200 and 230° C. samples, an improvement was observed when the samples were post-baked instead of laminated.

Figure 11:
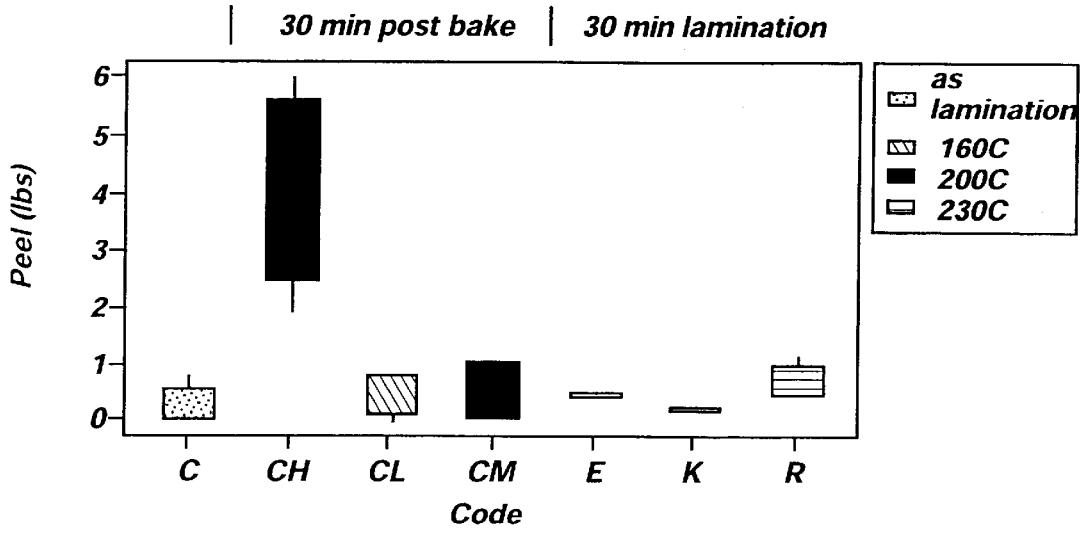
Figure 12:
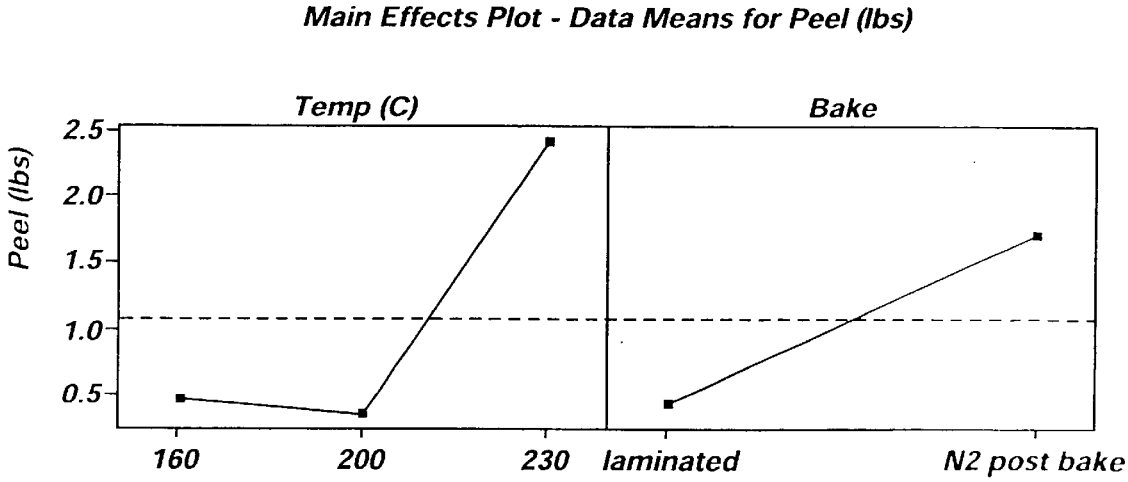

FIG. 11 shows a boxplot of each of the conditions containing Lotader® 8840 adhesive. The as-laminated parts used for post bake were included for comparison (see sample C). As previously discussed with reference to Example VI, all of the peel strengths from the lamination DOE were between 0 and 1. In the present test, the samples that were post baked at 230° C. showed a significant improvement in peel strength. Similar to the 8900 samples baked at 230° C., this group required a very high force to initiate the peel. The main effects for this group are shown in FIG. 12 and were deemed significant based on p values. Like the Lotader® 8900 samples, the post bake was more effective in improving adhesion than long times in the laminator. However, the best results occurred at the highest temperature.

Figure 13:
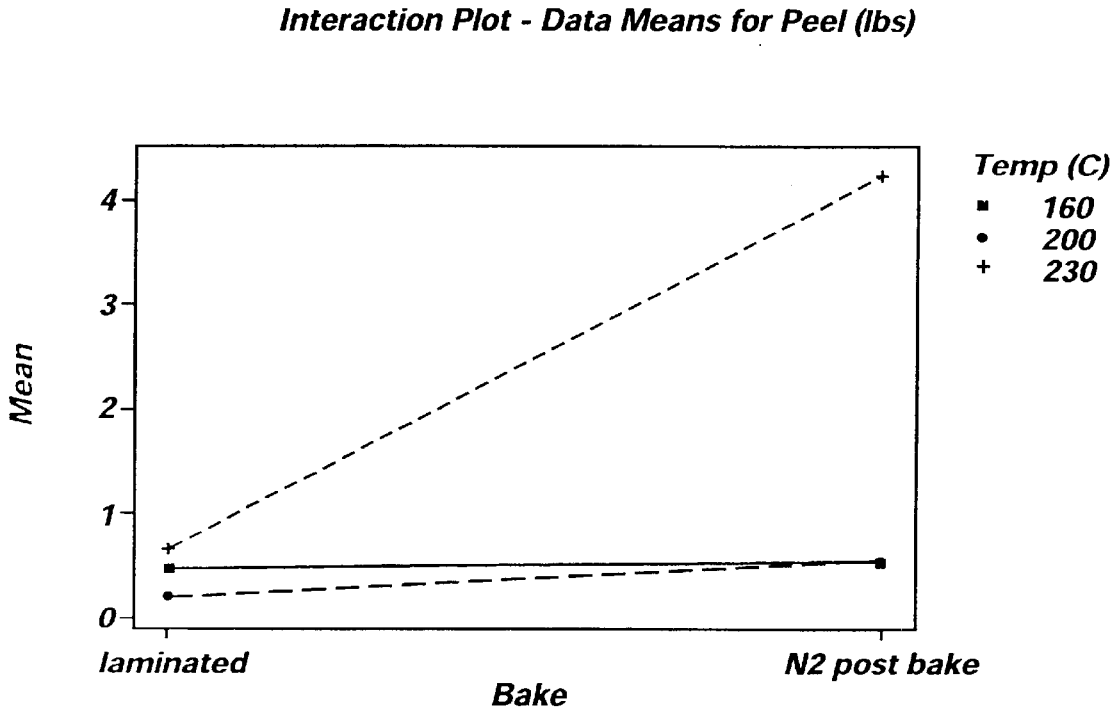
Figure 14:
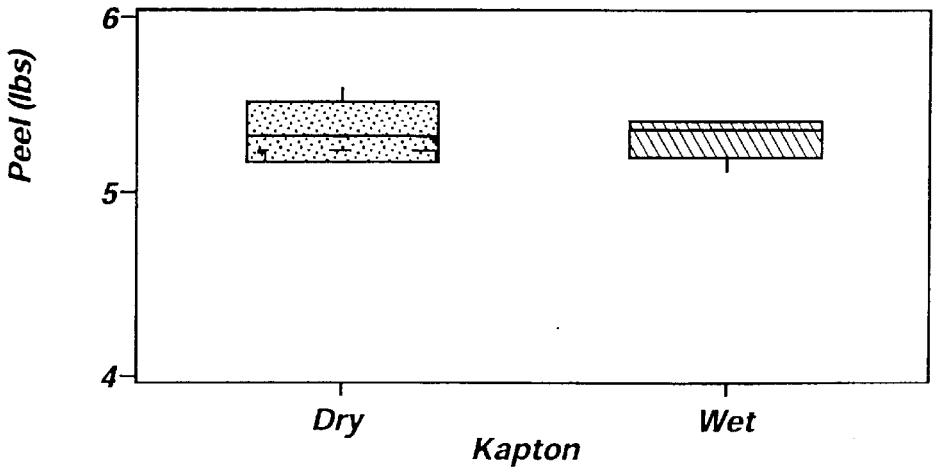
FIG. 14 depicts the peel strength between samples of wet and dry polymer tape containing adhesives of the present invention.

FIG. 13 shows the interaction for Lotader® 8840 for lamination and post-bake samples. The post-bake condition exhibited greatest effectiveness at the highest temperature (230° C.). The samples prepared in the laminator exhibited reduced comparative peel strength.

Example VIII

High Heat Lotader® 8840 Peel Test

A group of samples were prepared using Lotader® 8840 laminated at 240° C. for 15 seconds. These samples exhibited an average peel strength of 0.936 pounds. This represents an improvement in peel strength over all the other sample groups laminated for 15 seconds (e.g., C–230° C.; B–200° C.; H–160° C., shown in FIG. 6).

Thus, structures and methods for preventing ink shorts in a print assembly have been described. The precise shapes and dimensions of headland patterns will be determined by the type of printhead structure used. The foregoing has described the principles, preferred embodiments and modes of operation of the present invention. However, the invention should not be construed as being limited to the particular embodiments discussed. As an example, the above-described inventions can be used in conjunction with inkjet printers that are not of the thermal type, as well as inkjet printers that are of the thermal type. Thus, the above-described embodiments should be regarded as illustrative rather than restrictive, and it should be appreciated that variations may be made in those embodiments by workers skilled in the art without departing from the scope of the present invention as defined by the following claims. Having thus described certain preferred embodiments of the present invention, it is to be understood that the invention defined by the appended claims is not to be limited by particular details set forth in the above description, as many apparent variations thereof are possible without departing from the spirit or scope thereof as hereinafter claimed.

What is claimed is:

1. A print cartridge for an inkjet printer comprising:

a polymer tape having a nozzle member formed therein and having a first surface containing conductors thereon, said nozzle member including a plurality of ink orifices;

a coverlayer having a first and second surfaces, each coverlayer surface having an adhesive coated thereon, said coverlayer first surface being bonded to said first surface of said polymer tape by said adhesive and substantially encapsulating said conductors, said adhesive preventing electrical shorts caused by water vapor or ink, said adhesive comprising a polymer of ethylene and glycidyl methacrylate; and a print cartridge body containing an ink-retaining compartment therein, said print coverlayer being bonded to said print cartridge body and said nozzle member being in fluid communication with said ink-retaining compartment.

2. The print cartridge of claim 1, wherein said adhesive further comprises an acrylic ester.

3. The print cartridge of claim 1, wherein said adhesive further comprises an acrylic epoxy.

4. The print cartridge of claim 1, wherein said glycidyl methacrylate comprises about 8 weight percent of said adhesive.

5. The print cartridge of claim 1, wherein said coverlayer comprises polyethylene terephthalate.

6. The print cartridge of claim 1, wherein said coverlayer is shaped to match the configuration of said polymer tape.

7. The print cartridge of claim 1, wherein said adhesive comprises a first adhesive bonded to said first surface of said coverlayer and a second adhesive bonded to said second surface of said coverlayer, wherein said first adhesive and said second adhesive are different from one another.

8. A structure for preventing ink shorting of conductors connected to a printhead, said structure comprising a layer of insulating material shaped to at least partially encapsulate said conductors, said insulating material including a first surface and a second surface, each said surface having an adhesive coated thereon, said adhesive comprising a polymer of ethylene and glycidyl methacrylate.

9. The structure of claim 8, wherein said adhesive further comprises an acrylic ester.

10. The structure of claim 8, wherein said adhesive further comprises an acrylic epoxy.

11. The structure of claim 8, wherein said glycidyl methacrylate comprises about 8 weight percent of said adhesive.

12. The structure of claim 8, wherein said insulating material comprises polyethylene terephthalate.

13. The structure of claim 8, wherein said adhesive comprises a first adhesive bonded to said first surface of said insulating material and a second adhesive bonded to said second surface of said insulating material, wherein said first adhesive and said second adhesive are different from one another.

14. A method of producing a print cartridge for use in an inkjet cartridge comprising:

providing a polymer tape having a nozzle member formed therein and having a first surface containing conductors thereon, said nozzle member having a plurality of ink orifices;

providing a coverlayer having a first and second surfaces, each coverlayer surface having an adhesive coated thereon;

bonding said coverlayer first surface to said first surface of said polymer tape to substantially encapsulate said conductors and prevent electrical shorts caused by water vapor or ink, said adhesive comprising a polymer of ethylene and glycidyl methacrylate; and providing a print cartridge body containing an ink-retaining compartment therein; and bonding said coverlayer second surface to said print cartridge body such that said nozzle member is in fluid communication with said ink-retaining compartment.

15. The method of claim 14, wherein said adhesive further comprises an acrylic ester.

16. The method of claim 15, wherein said adhesive further comprises an acrylic epoxy.

17. The method of claim 14, wherein said glycidyl methacrylate comprises about 8 weight percent of said adhesive.

18. The method of claim 14, wherein said coverlayer comprises polyethylene terephthalate.

19. The method of claim 14, wherein said coverlayer is shaped to match the configuration of said polymer tape.

20. The method of claim 14, wherein said adhesive comprises a first adhesive bonded to said first surface of said coverlayer and a second adhesive bonded to said second surface of said coverlayer, wherein said first adhesive and said second adhesive are different from one another.

* * * * *

UNITED STATES PATENT AND TRADEMARK OFFICE

CERTIFICATE OF CORRECTION

PATENT NO. : 6,663,235 B2
DATED : December 16, 2003
INVENTOR(S) : Erickson et al.

It is certified that error appears in the above-identified patent and that said Letters Patent is hereby corrected as shown below:

Column 10,
Line 14, delete “a first and second surfaces,” and insert therefor -- a first surface and a second surface, --.
Line 22, delete “said print coverlayer” and insert therefor -- said coverlayer second surface --.

Column 11,
Line 1, delete “a first and second surfaces,” and insert therefor -- a first surface and a second surface, --.

Signed and Sealed this

First Day of June, 2004

JON W. DUDAS
*Acting Director of the United States Patent and Trademark Office*